US010132596B2

(12) United States Patent
Bartoszewicz

(10) Patent No.: US 10,132,596 B2
(45) **Date of Patent: *Nov. 20, 2018**

(54) TECHNOLOGIES FOR FIREARM ACCESSORY MOUNTING

(71) Applicant: Philippe Bartoszewicz, South Orange, NJ (US)

(72) Inventor: Philippe Bartoszewicz, South Orange, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/606,834

(22) Filed: May 26, 2017

(65) Prior Publication Data

US 2017/0261288 A1 Sep. 14, 2017

Related U.S. Application Data

(63) Continuation-in-part of application No. 14/882,287, filed on Oct. 13, 2015, now Pat. No. 9,671,198.

(51) Int. Cl.
*F41G 11/00* (2006.01)

(52) U.S. Cl.
CPC ..... *F41G 11/003* (2013.01)

(58) Field of Classification Search
CPC ..... F41G 1/16; F41G 1/18; F41G 1/22; F41G 1/38; F41G 1/387; F41G 1/393; F41G 1/40; F41G 1/41; F41G 11/003; F41G 11/004
USPC ..... 42/124, 125, 126, 127, 128; 89/37.04
See application file for complete search history.

(56) References Cited

U.S. PATENT DOCUMENTS

| | | | | |
|---|---|---|---|---|
| 2,005,866 | A * | 6/1935 | Lowe | F41G 1/16 42/137 |
| 4,291,478 | A | 9/1981 | Lough | |
| 4,494,328 | A | 1/1985 | Stevens | |
| 4,845,871 | A | 7/1989 | Swan | |
| 5,092,071 | A | 3/1992 | Moore | |
| 6,722,074 | B1 | 4/2004 | Farrell | |
| 7,272,904 | B2 | 9/2007 | Larue | |
| 7,493,721 | B2 | 2/2009 | Swan | |
| 7,712,242 | B2 | 5/2010 | Matthews et al. | |
| 7,823,316 | B2 | 11/2010 | Storch et al. | |
| 7,900,390 | B2 | 3/2011 | Moody et al. | |
| 8,128,047 | B1 | 3/2012 | Lame | |
| 8,276,307 | B2 | 10/2012 | Deros | |

(Continued)

OTHER PUBLICATIONS

Aim Point QRP2 Quick Release Mounts for CompM4 Red Dots 12195, downloaded from the internet Oct. 13, 2015, http://www.opticsplanet.com/aimpoint-quick-release-picatinny-qrp-mount-complete-and-qrp2-base-only.html (4 pages).

*Primary Examiner* — Bret Hayes
(74) *Attorney, Agent, or Firm* — Dentons US LLP

(57) ABSTRACT

A firearm mount comprises a platform, first and second pairs of columns extending therefrom, and first and second sidewalls spanning the first and second pairs of columns, respectively. The first sidewall defining a bore and the second sidewall defining an arcuate portion, wherein the bore and the arcuate portion are collinear along a plane. A bridge spans the first and second sidewalls, such that the bridge is positioned between the plane and the platform. The mount further comprises a fastener and a plate, wherein the plate comprises a tubular portion having an open end, the tubular portion extending from the plate and through the arcuate portion when the fastener extends through the bore and fastens to the tubular portion.

18 Claims, 19 Drawing Sheets

(56) References Cited

U.S. PATENT DOCUMENTS

| | | | | |
|---|---|---|---|---|
| 8,567,105 | B1 | 10/2013 | Bobro | |
| 8,578,647 | B2 | 11/2013 | Storch et al. | |
| 8,667,727 | B2 | 3/2014 | Engelhardt | |
| 8,769,859 | B2 | 7/2014 | Li et al. | |
| 9,671,198 | B2 * | 6/2017 | Bartoszewicz | F41G 11/003 |
| 2006/0207156 | A1 | 9/2006 | Larue | |
| 2010/0229450 | A1 | 9/2010 | Becker et al. | |
| 2012/0279107 | A1 * | 11/2012 | Hoel | F41G 11/003 42/90 |
| 2017/0219314 | A1 * | 8/2017 | McMakin | F41C 33/008 |

* cited by examiner

TECHNOLOGIES FOR FIREARM ACCESSORY MOUNTING

CROSS-REFERENCE TO RELATED APPLICATIONS

This application is a Continuation-in-Part of U.S. patent application Ser. No. 14/882,287, filed on Oct. 13, 2015, which is herein fully incorporated by reference for all purposes.

TECHNICAL FIELD

Generally, the present disclosure relates to firearms. More particularly, the present disclosure relates to firearm rails.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure is concerned with. Further, nothing is disclaimed.

A firearm, especially a military firearm, such as an M16 rifle, is often equipped with a standardized elongated rail for securely mounting a firearm capability enhancement accessory, such as an aiming device, a lighting device, a gripping device, a rangefinder, a scope, a sling, or many others. Such rail frequently comprises a T-shaped cross-section with a top of the T-shape corresponding to a top of the rail. Furthermore, such rail can be slotted transversely along a length of the rail, allowing for an indexed spacing of the accessory. Some examples of such rail include MIL-STD-1913 Picatinny, NATO Accessory Rail (STANAG 4694), or a Weaver Rail.

An accessory mount can be used to attach the accessory to the rail. Typically, the accessory mount tends to employ a multitude of screws or levers for locking the onto the transverse slots of the rail. However, the accessory mount that employs the screws often relies on relatively large frictional forces between the screws and a base of the accessory mount to remain securely fastened under a recoil of the firearm in various field conditions. To achieve this minimum torque, such accessory mount involves a separate tool to fasten the screws, which inconveniences a firearm operator by having the firearm operator carry this specific tool, which can be lost. Also, such high level of torque can cause the accessory mount to flex, which affects a point of aim of the accessory. As a result, the base made to use the screws are frequently overbuilt to resist this flex. Even if fastened with a high level of torque, the screws can eventually loosen under the recoil of the firearm, and as such, the screws often remain fastened through an externally applied threadlocking chemical. Most common commercial threadlocking chemicals function best when the screws are cleaned and dried prior to reapplication of the threadlocking chemical in case of re-installation of the accessory mount. This again inconveniences the firearm operator forcing the firearm operator to carry the threadlocking chemical and related cleaning supplies, which is cumbersome and impractical in various field conditions.

When the accessory mount employs a thumbscrew as a primary rail fastening means, drawbacks still remain. For example, such accessory mount also relies on comparatively large frictional forces between the thumbscrew and the base to remain securely fastened under the recoil of the firearm rifle and various field conditions. As the screws described above, the thumbscrew mount suffers from similar drawbacks, but in addition a head of the thumbscrew is often excessively large in order to provide an average firearm operator sufficient leverage to achieve the minimum torque needed to secure the accessory mount using only the firearm operator's hands. Therefore, such large thumbscrew head protrudes excessively from the accessory mount causing a risk of being caught on clothing, equipment, or surroundings, sometimes even impeding a proper function of the firearm. Additionally, the large thumbscrew can add to a weight of the accessory mount, which is detrimental to the firearm operator's comfort and ability to quickly maneuver the firearm. Furthermore, experience has shown that even a tightly fastened thumbscrew is likely to loosen without some secondary means of securing the thumbscrew from loosening under vibration of the firearm's recoil, such as s threadlocking chemical or a secondary set screw. Both of these solutions are cumbersome and impractical in various field conditions.

Although throw-lever actuated locking mechanisms exist, such mechanisms suffer from having levers which protrude from the accessory mount. Such lever can easily get caught on clothing, gear, and surroundings. Further, such lever and an associated ancillary lever locking mechanism add considerable weight, size, or complexity by involving a large number of components with the accessory mount, while introducing non-intuitive operating procedures to unlock and lock the lever. Like a high torque screw accessory mount, as described above, the lever mount can introduce high levels of stress into the base, which can cause the base to flex and potentially shift the point of aim of the accessory. Unlike screw or thumbscrew type accessory mounts, which can use a shaft of the screw or thumbscrew to act as a recoil lug, a lever actuated accessory mount requires a distinct shear lug to be machined or otherwise formed into the base in order to securely lock the accessory mount within the transverse slots of the rail. Such state of being further adds cost, and weight to the accessory mount.

BRIEF SUMMARY

The present disclosure at least partially addresses at least one of the above. However, the present disclosure can prove useful to other technical areas. Therefore, the claims should not be construed as necessarily limited to addressing any of the above.

In an example embodiment, a device comprises a firearm accessory mount comprising: a platform structured to support a firearm accessory; a first pair of columns extending from the platform; a first sidewall spanning between the first pair of columns, wherein the first sidewall defines a first bore, wherein the first pair of columns and the first sidewall define a first jaw structured to grip a first side of a firearm rail; a second pair of columns extending from the platform; a second sidewall spanning between the second pair of columns, wherein the second sidewall defines a second bore, wherein the first bore and the second bore are collinear along a plane; a bridge spanning between the first sidewall and the second sidewall along the plane such that the bridge is positioned between the plane and the platform; a thumbscrew comprising a head and a stem; a plate comprising a tube extending therefrom, wherein the tube comprises an open end distal to the plate, wherein the tube is sized to fit through the second bore, wherein the plate defines a second jaw structured to grip a second side of the firearm rail when the head is positioned along the first sidewall between the first pair of columns, when the stem extends through the first bore along the bridge into the open end such that the stem fastens to the tube as the tube extends through the second bore along the bridge, and when the bridge is positioned between the tube and the platform.

In an example embodiment, a device comprises a firearm accessory; a first pair of columns extending from the firearm accessory; a first sidewall spanning between the first pair of columns, wherein the first sidewall defines a first bore, wherein the first pair of columns and the first sidewall define a first jaw structured to grip a first side of a firearm rail; a second pair of columns extending from the firearm accessory; a second sidewall spanning between the second pair of columns, wherein the second sidewall defines a second bore, wherein the first bore and the second bore are collinear along a plane; a bridge spanning between the first sidewall and the second sidewall along the plane such that the bridge is positioned between the plane and the firearm accessory; a thumbscrew comprising a head and a stem; a plate comprising a tube extending therefrom, wherein the tube comprises an open end distal to the plate, wherein the tube is sized to fit through the second bore, wherein the plate defines a second jaw structured to grip a second side of the firearm rail when the head is positioned along the first sidewall between the first pair of columns, when the stem extends through the first bore along the bridge into the open end such that the stem fastens to the tube as the tube extends through the second bore along the bridge, and when the bridge is positioned between the tube and the firearm accessory.

In an example embodiment, the device comprises a first pair of columns; a first sidewall spanning between the first pair of columns, wherein the first sidewall defines a first bore, wherein the first pair of columns and the first sidewall define a first jaw structured to grip a first side of a firearm rail; a second pair of columns; a second sidewall spanning between the second pair of columns, wherein the second sidewall defines a second bore, wherein the first bore and the second bore are collinear along a plane; a bridge spanning between the first sidewall and the second sidewall along the plane; a thumbscrew comprising a head and a stem; a plate comprising a tube extending therefrom, wherein the tube comprises an open end distal to the plate, wherein the tube is sized to fit through the second bore, wherein the plate defines a second jaw structured to grip a second side of the firearm rail when the head is positioned along the first sidewall between the first pair of columns and when the stem extends through the first bore along the bridge into the open end such that the stem fastens to the tube as the tube extends through the second bore along the bridge; a bipod joint coupled to the bridge.

The present disclosure may be embodied in the form illustrated in the accompanying drawings. However, attention is called to the fact that the drawings are illustrative. Variations are contemplated as being part of the disclosure, limited only by the scope of the claims.

BRIEF DESCRIPTION OF DRAWINGS

The accompanying drawings illustrate example embodiments of the present disclosure. Such drawings are not to be construed as necessarily limiting the disclosure. Like numbers and/or similar numbering scheme can refer to like and/or similar elements throughout.

DETAILED DESCRIPTION OF PREFERRED EMBODIMENTS

Figure 1:
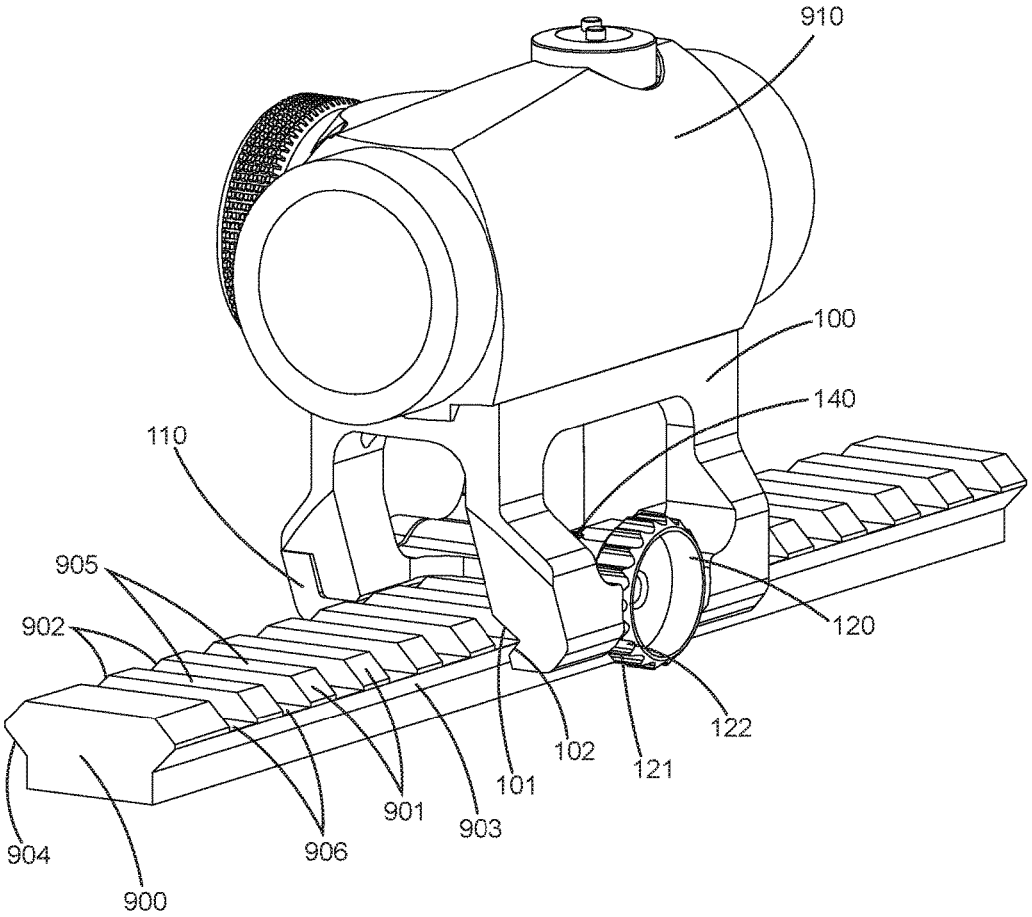
FIG. 1 shows a top perspective view of an example embodiment of an accessory mount supporting a firearm scope and mounted onto a firearm rail according to the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments disclosed herein. Rather, these example embodiments are provided so that the present disclosure is thorough and complete, and fully conveys the concepts of the present disclosure to those skilled in the relevant art.

Features described with respect to certain example embodiments may be combined and sub-combined in and/or with various other example embodiments. Also, different aspects and/or elements of example embodiments, as disclosed herein, may be combined and sub-combined in a similar manner as well. Further, some example embodiments, whether individually and/or collectively, may be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity in any manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from the teachings of the present disclosure.

The terminology used herein is for describing particular example embodiments and is not intended to be necessarily limiting of the present disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence and/or addition of one or more other features, integers, steps, operations, elements, components, and/or groups thereof.

As used herein, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (30) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, a gemstone, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical to and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" can be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

As used herein, the term "about" and/or "substantially" refers to a +/−10% variation from the nominal value/term. Such variation is always included in any given value/term provided herein, whether or not such variation is specifically referred thereto.

If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

In some embodiments, the present disclosure enables quick-release mounting devices for releasably mounting various devices on a support structure. The present disclosure also enables firearms and releasable sighting or aiming devices for rifles. The present disclosure also enables mounting devices having adjustable locking mechanisms and mounting rings for releasably securing aiming devices, such as sighting telescopes of rifles and similar firearms, and for maintaining optimum sighting accuracy even when a firearm is subjected to repeated heavy recoil when firing high velocity, large bore ammunition. The present disclosure also enables locking type mounting rings that enable rifle sighting devices to be simply and efficiently removable and replaceable under field conditions, while maintaining a preset zero when replaced.

In some embodiments, the present disclosure enables a selectively releasable accessory mount for mounting onto a firearm accessory rail, where the accessory mount is able to slide over the firearm accessory rail, is made of a resilient material, and includes one or more thumbscrew fasteners with a mechanical means of preventing loosening under recoil. The accessory mount not only can be selectively and releasably fastened to the firearm accessory rail without a use of a tool, such as via inward pressure or clamping, but also can withstand high levels of rifle recoil without requiring excessive torque to be applied by a firearm operator, limiting a size of a thumbscrew wheel's diameter and surface area, which results in a streamlined and lightweight design. The accessory mount can also be highly recoil resistant without a need to apply threadlocking chemical. Furthermore, the accessory mount allows for a superior level of positional repeatability, which allows for accurate re-installation of an aiming optic without shifting a point of aim of the aiming optic. The accessory mount allows for a separation of a force required to keep a thumbscrew from loosening during forces present under firearm recoil and a force that moves a base of the accessory mount to remain clamped to the firearm accessory rail.

In some embodiments, a thumbscrew comprises a head and a stem extending from the head, such as in a T-shape manner. Accordingly, when the head is manually rotated by the firearm operator in a preferred direction, as is prescribed by a direction of a threading of the stem and a threading of a clamp plate tube, the thumbscrew pulls a clamp plate tube towards the head, while the clamp plate and a base of the accessory mount abut the firearm rail, thereby exerting inward pressure on the firearm rail. A disc spring or similar elastic component can be positioned between the head and the base to provide a tension desired to keep the accessory mount fixed to the firearm rail, while a ball detent mechanism that interfaces with the thumbscrew head provides enough resistance to prevent the thumbscrew head from loosening through an action of the firearm's recoil or from accidental displacement.

In some embodiments, the present disclosure enables a wedge with a bore therethrough to capture the clamp plate and a corresponding bore in the base along with a half dog point set screw to capture the thumbscrew from an opposite side of the base of the mount.

In some embodiments, a comparatively long length of thread on the thumbscrew stem and a tube of the clamp plate allows for tension forces to be spread over a large surface area, which reduces material stress and allows such components to be manufactured from lighter weight materials and of a smaller diameter than would otherwise be possible.

In some embodiments, a linear motion of the clamp plate provides for a very repeatable positional accuracy for the accessory mount, which affords any sighting or laser aiming devices mounted thereto to retain a respective point of aim more accurately when repeatedly mounting and dismounting from the firearm.

In some embodiments, the clamp plate's and the base's comparatively large clamping surfaces and a relatively low torque required to secure the thumbscrew in place reduces a pressure on the firearm accessory rail, which minimizes marring and damage to the firearm accessory rail, which can degrade a dimensional integrity of the firearm accessory rail over repeated mountings and dismountings.

In some embodiments, a relatively low torque required to secure the thumbscrew in place reduces an amount of stress introduced into the base, which permits the base to be manufactured from thinner members and of lighter materials, which contributes to a smaller profile or lighter weight.

Figure 2:
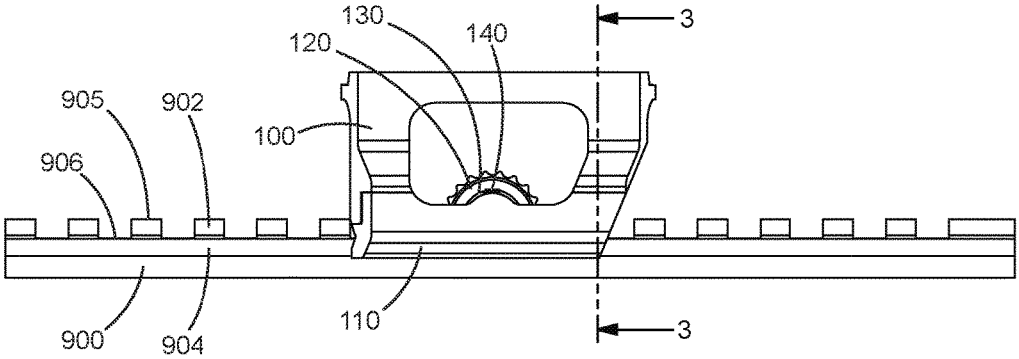
FIG. 2 shows a longitudinal side view of an example embodiment of an accessory mount according to the present disclosure.
Figure 3:
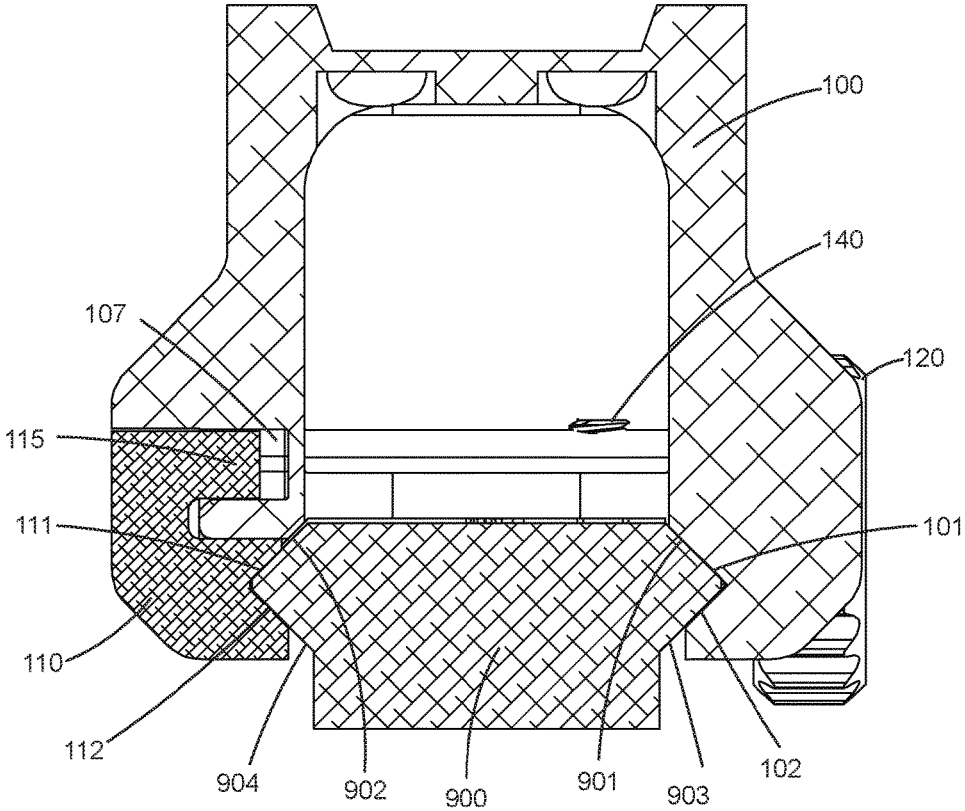
FIG. 3 shows a cross-sectional view of an example embodiment of an accessory mount according to the present disclosure.
Figure 4:
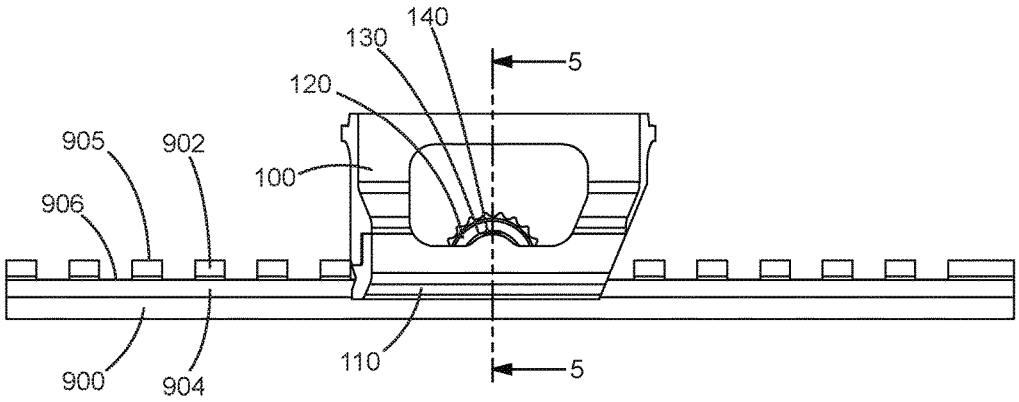
FIG. 4 shows a longitudinal side view of an example embodiment of an accessory mount according to the present disclosure.
Figure 5:
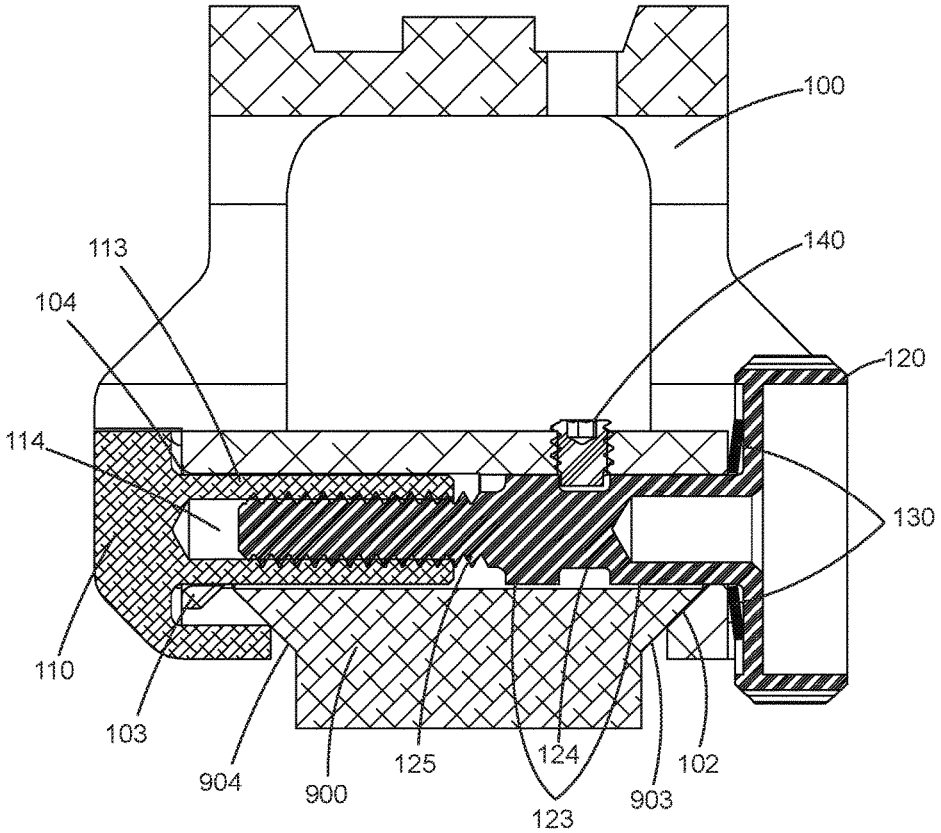
FIG. 5 shows a cross-sectional view of an example embodiment of an accessory mount according to the present disclosure.
Figure 6:
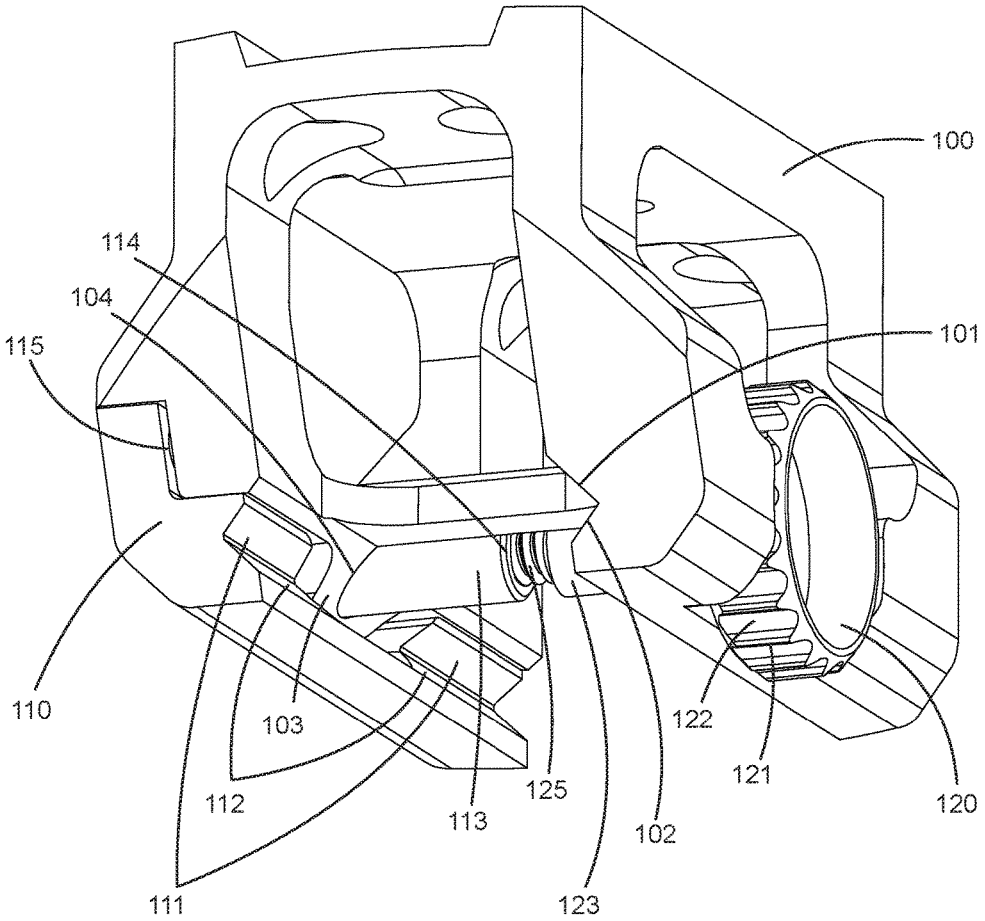
FIG. 6 shows a bottom perspective view of an example embodiment of an accessory mount according to the present disclosure.
Figure 7:
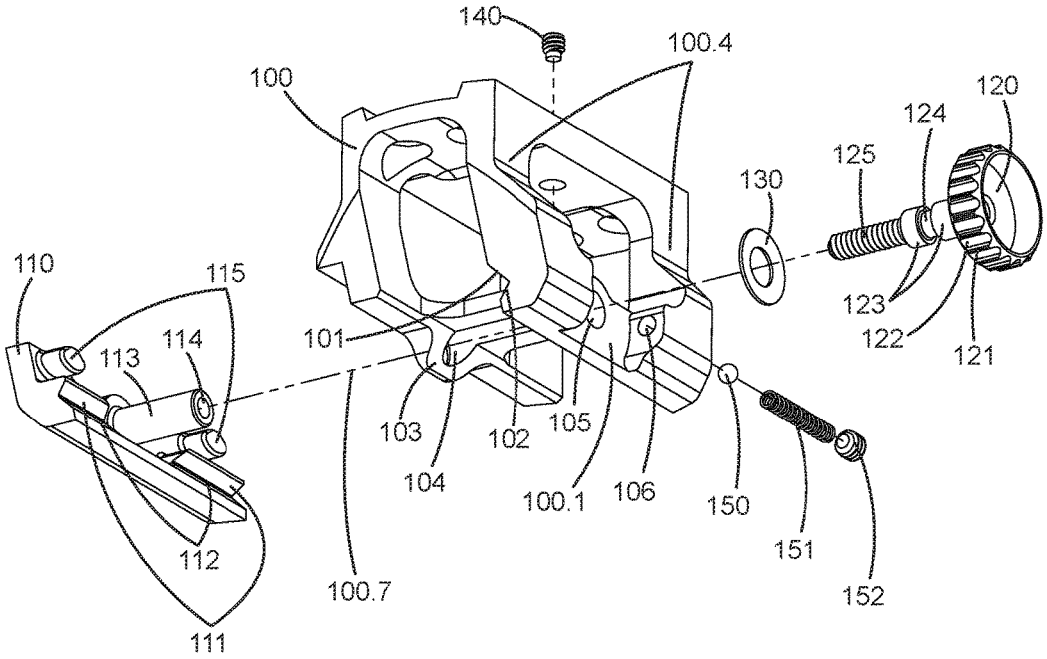
FIG. 7 shows a bottom perspective view of an example embodiment of an accessory mount according to the present disclosure.
Figure 8:
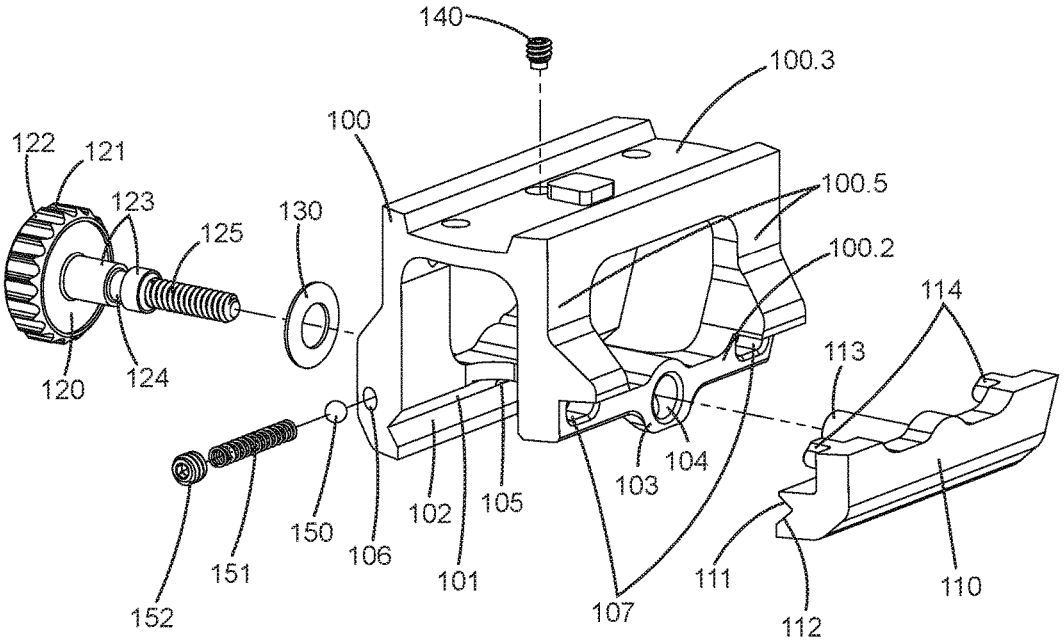
FIG. 8 shows a top perspective view of an example embodiment of an accessory mount according to the present disclosure.
Figure 9:
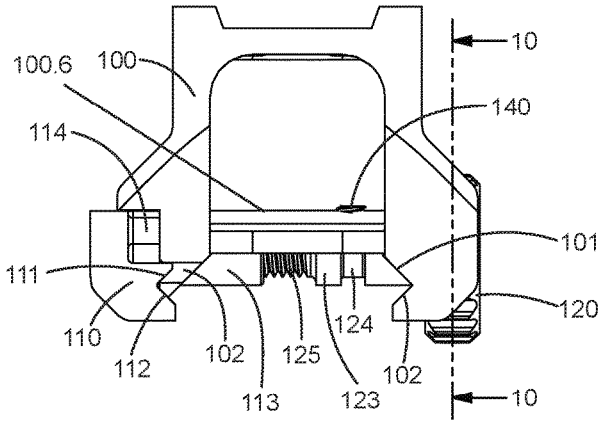
FIG. 9 shows a frontal side view of an example embodiment of an accessory mount being disassembled according to the present disclosure.
Figure 10:
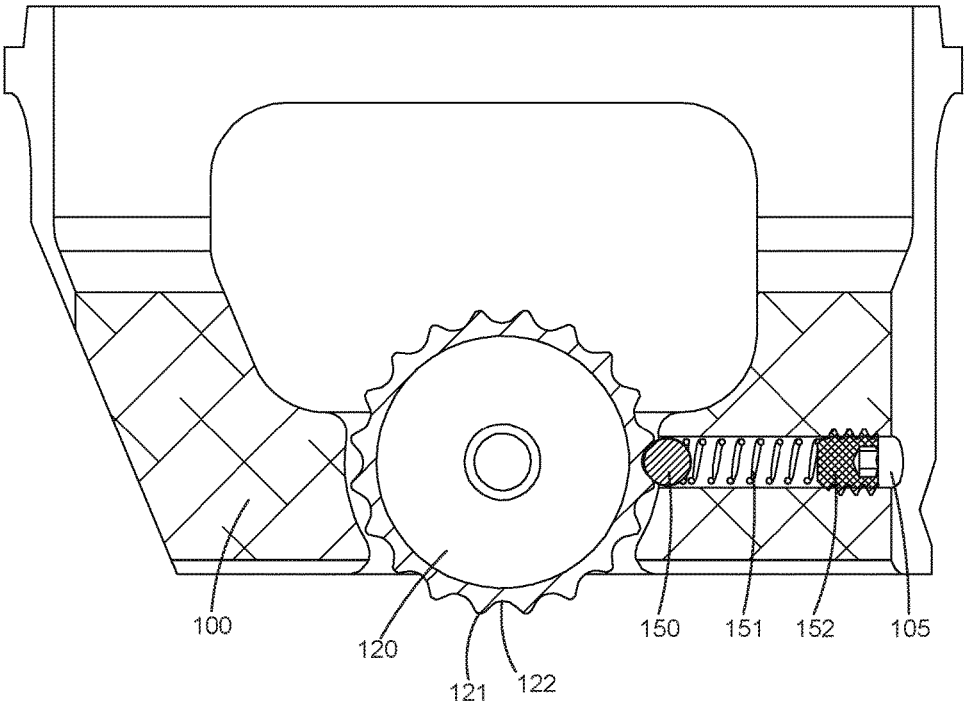
FIG. 10 shows a cross-sectional view of an example embodiment of an accessory mount where a ball plunger interfaces with a thumbscrew according to the present disclosure.

FIG. 1 shows a top perspective view of an example embodiment of an accessory mount supporting a firearm scope and mounted onto a firearm rail according to the present disclosure. FIG. 2 shows a longitudinal side view of an example embodiment of an accessory mount according to the present disclosure. FIG. 3 shows a cross-sectional view of an example embodiment of an accessory mount according to the present disclosure. FIG. 4 shows a longitudinal side view of an example embodiment of an accessory mount according to the present disclosure. FIG. 5 shows a cross-sectional view of an example embodiment of an accessory mount according to the present disclosure. FIG. 6 shows a bottom perspective view of an example embodiment of an accessory mount according to the present disclosure. FIG. 7 shows a bottom perspective view of an example embodiment of an accessory mount according to the present disclosure. FIG. 8 shows a top perspective view of an example embodiment of an accessory mount according to the present disclosure. FIG. 9 shows a frontal side view of an example embodiment of an accessory mount being disassembled according to the present disclosure. FIG. 10 shows a cross-sectional view of an example embodiment of an accessory mount where a ball plunger interfaces with a thumbscrew according to the present disclosure.

As shown in FIGS. 1-10, an accessory mount comprises a base 100 which supports an optical sighting device 910, such as sighting scope. The base 100 enables a selective and releasable mounting of the optical sighting device 910 onto a mounting rail 900 of a firearm, such as MIL-STD-1913 Picatinny, NATO Accessory Rail (STANAG 4694), or a Weaver Rail, where the mounting rail 900 is affixed or coupled to the firearm or another object. The rail 900 comprises a number of evenly spaced upwardly extending mounting projections 905, which define evenly spaced transverse slots 906 therebetween to provide for selective location mounting of an accessory on the firearm, such as the optical sighting device 910. Each of the evenly spaced upwardly extending mounting projections 905 defines undercut parallel, oppositely angulated clamping surfaces 903 and 904 and oppositely angulated, typically upwardly facing support surfaces 901 and 902 that are disposed in angulated relation with one another. Each of the clamping surfaces 903 and 904 and the support surfaces 901 and 902 are initially formed by elongated surfaces, typically extending a length of the rail 900 and are interrupted by the transverse slots 906 that are machined or otherwise formed in evenly spaced relation along the length of the rail 900.

The base 100 comprises a platform 100.3, which can be U-shaped, structured to support a firearm accessory, such as the optical sighting device 910, a first pair of columns 100.4 supportively extending from the platform 100.3, a first sidewall 100.1 spanning between the first pair of columns 100.4, a second pair of columns 100.5 supportively extending from the platform 100.3, a second sidewall 100.2 spanning between the second pair of columns 100.5, a bridge 100.6 spanning between the first sidewall 100.1 and the second sidewall 100.2 along a plane 100.7 such that the bridge 100.6 is positioned between the plane 100.7 and the platform 100.3, such as via extending lateral to the rail 900 along or above at least one of the projections 905, a thumbscrew 120 comprising a head with scallops 122 and a stem, and a plate 110 comprising a tube 113 extending therefrom, where the tube 113 comprises an open end 114 distal to the plate 110. The first sidewall 100.1 defines a first bore 105. The first pair of columns 100.4 and the first sidewall 100.1 define a first jaw structured to grip a first side of a firearm rail 900, such as the surface 903. The second sidewall 100.2 defines a second bore 104, where the first bore 105 and the second bore 104 are collinear along the plane 100.7, such as lateral to the rail 900 along or above at least one of the projections 905. The tube 113 is sized to fit through the second bore 104. The plate 110 defines a second jaw structured to grip a second side of the firearm rail 900, such as the surface 904, when the head of the thumbscrew 120 is positioned along the first sidewall 100.1 between the first pair of columns 100.4, when the stem of the thumbscrew 120 extends through the first bore 105 along the bridge 100.6 into the open end 114 such that the stem of the thumbscrew 120 fastens to the tube 113 as the tube 113 extends through the second bore 104 along the bridge 100.6, and when the bridge 100.6 is positioned between the tube 113 and the platform 100.3. For example, the base 100 can function as a vise or a clamp, with the first jaw being stationary and the second jaw being movable to apply inward pressure, such as via releasable fastening. In some embodiments, the base 100 can comprise a first window defined via the first pair of columns 100.4, the first sidewall 100.1, and the platform 100.3. In some embodiments, the base 100 can comprise a second window defined via the second pair of columns 100.5, the second sidewall 100.2, and the platform 100.3, where the first window and the second can be identical to or different from each other in shape or size. In some embodiments, the platform 100.3, the first pair of columns 100.4, and the second pair of columns 100.4 define a front window and back window, which can be identical to or different from each other in shape or size.

A fastener 140, such as a set screw, extends through a bore in the bridge and contacts the stem of the thumbscrew 120 such that the stem is able to rotate freely to prevent the thumbscrew 120 from sliding back and forth. A cross-section through a 3-3 line depicts the plate 110 with a shear lug 115 fitting into a corresponding shear lug pocket 107 underneath a column of the second pair of columns on the base 100. The second jaw comprises an upper clamping surface 111 of the plate 110 and a lower clamping surface 112 of the plate 110. The upper clamping surface 111 of the plate 110 abuts the upper supporting surfaces 902 on the rail 900, while the lower clamping surface 112 of the plate 110 abuts the lower supporting surfaces 904 on the 900. On an opposite side of the base 100, a rail receiving receptacle, such as the first jaw, is formed by an upper clamping surface 101 of the base 100 and a lower clamping surface 102 of the base 100. The upper clamping surface 101 of the base 100 abuts the upper supporting surface 901 of the rail 900, while the lower clamping surface 102 of the base 100 abuts the lower supporting surface 903 of the rail 900.

A cross-section through a 5-5 line depicts the plate 110 with the tube 113, where the tube 113 passes through the second bore 104 formed in a protruding wedge 103 on a side of the base 100, such as the second sidewall. On an opposite side of the base 100, the thumbscrew 120 comprises the stem with a threaded stem portion 125 extending collinearly along an axis thereof. The threaded stem portion 125 is shown threading into the open end 114 of the tube 113. The tube 113 and an unthreaded stem portion 123 ride inside the transverse slots 906 and situate the mount 100 securely along the rail 900. Note that the bridge is positioned between the platform and at least one of the stem or the tube 113. The fastener 140, such as a half dog point set screw, contacts the stem by means of a capture channel 124 defined along in the unthreaded stem portion 123. An elastic member 130, such as a disc spring, which can be manufactured from a resilient, but flexible material, such as steel or plastic or composite or other metal, is shown positioned between a side of the head of the thumbscrew 120 facing the stem of the thumbscrew 120 and the first sidewall of the base 100.

As shown in FIG. 6, the base 100 with the plate 110 comprises the tube 113 passing through the second bore 104 in the protruding wedge 103 on one side of the base 100. On the opposite side of the base 100, the thumbscrew 120 comprises the threaded stem portion 125 extending collinearly along the axis thereof. The threaded stem portion 125 threads into the open end 114 of the tube 113. The tube 113 and the unthreaded stem portion 123 ride inside the transverse slots 906 and situate the mount 100 securely along the rail 900. The plate 110 comprises the upper clamping surfaces 111 and the lower clamping surfaces 112, which can define the second jaw. On the opposite side of the base 100, the rail receiving receptacle, which can define the first jaw, is formed by the upper clamping surface 101 and the lower clamping surface 102. The head of the thumbscrew 120 comprises an outer perimeter with the scallops 122 defined by a plurality of peaks 121.

The first bore 105 is sized such that the stem of the thumbscrew 120 is able to pass therethrough. The first pair of columns comprises a column, which defines a third bore 106. The third bore 106 is structured to receive a ball 150, an elastic member 151, such as a compression spring, and a fastener 152, such as a set screw. The ball 150 and the elastic member 151 are held in place by means of the fastener 152. Note that the ball 150 or another engager can comprise a hemispherical portion structured for engagement via a ball and detent methodology. However, other shaped portions are possible, whether additionally or alternatively, such as a polyhedron, whether spherical or non-spherical. The ball 150 and the elastic member 151 can also be combined into a entity, such as a flat spring.

As shown in FIG. 9, the plate 110 in an unlocked position exposes more of the shear lug 115 than in a locked position. Note that the plate 110 extends past a soffit of a column from the second pair of columns such that an open space between the plate 110 and the column from the second pair of columns is defined. Note that when there are at least two shear lugs 115, then the at least two shear lugs can be identical to or different from each other in at least one of structure, shape, orientation, material, or function.

A cross-section through a 10-10 line depicts how the ball 150 interfaces/interacts/engages with the scallops 122 on an outer perimeter of the head of the thumbscrew 120, i.e., an outer side extending along a perimeter of the head of the thumbscrew 120. The elastic member 151, such as a compression spring, is shown to elastically engage with the ball 150 on one end thereof and the fastener 152, such as a set screw, on an opposing end thereof.

Figure 11:
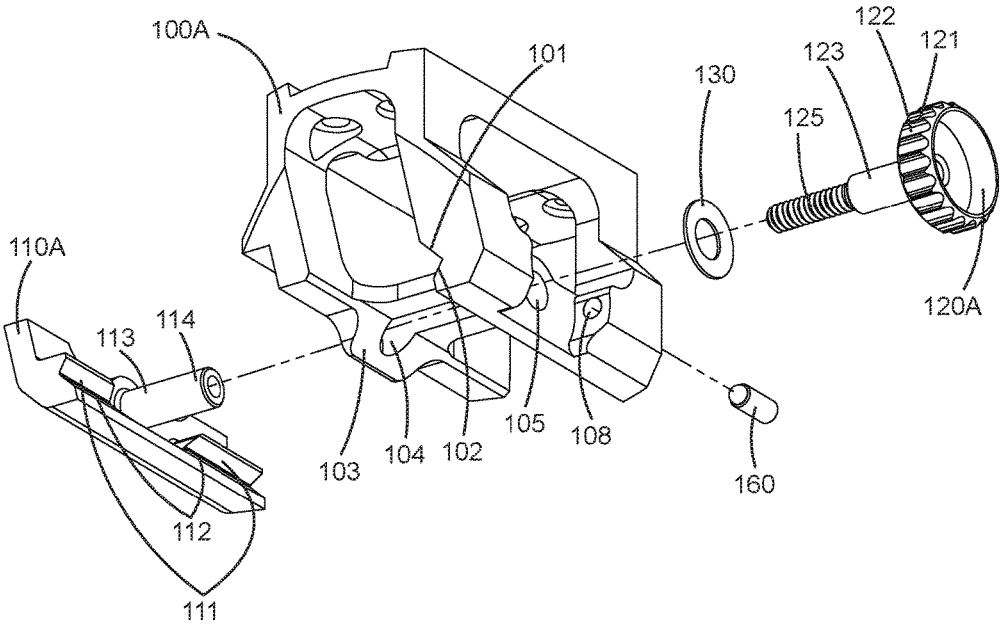
FIG. 11 shows a bottom exploded view of an example embodiment of an accessory mount without shear lugs and with a removable ball and detent assembly according to the present disclosure.

FIG. 11 shows a bottom exploded view of an example embodiment of an accessory mount without shear lugs and with a removable ball and detent assembly according to the present disclosure. Some elements of this figure are described above. Thus, same reference characters identify identical and/or like components described above and any repetitive detailed description thereof will hereinafter be omitted or simplified in order to avoid complication.

A plate 110A does not include any of the shear lugs 115. Accordingly, a base 100A does not include pockets 107 for the shear lugs 115.

A column from the first pair of columns defines a fourth bore 108 with a pair of open ends. A ball detent assembly 160 comprises a hemispherical portion and a cylinder with an open end, with the hemispherical portion being coupled to the cylinder in proximity of the open end. A spring or the hemispherical portion protrudes from the cylinder via the open end of the cylinder. The head of the thumbscrew 120A comprises a plurality of peaks 121, which define a plurality of depressions 122. The hemispherical portion engages the head of the thumbscrew 120 via at least one of the peaks 121 or the depressions 122 through the open end of the fourth bore 108 when the cylinder is inserted into the fourth bore 108 through the open end of the fourth bore 108. In some embodiments, the cylinder can be press-fit into the fourth bore 108. In some embodiments, the cylinder can be outwardly threaded and the fourth bore 108 being inwardly threaded such that the cylinder can be threaded into the fourth bore 108.

Figure 12:
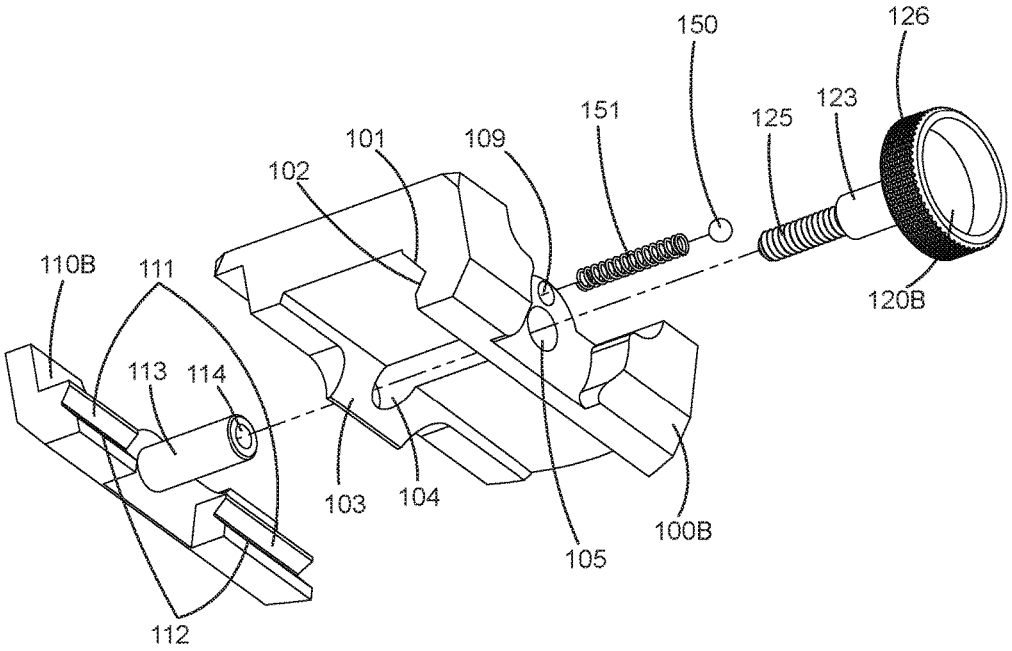
FIG. 12 shows a bottom exploded view of an example embodiment of an accessory mount without shear lugs and with a ball and detent assembly engaging an inner side of a head of a thumbscrew according to the present disclosure.
Figure 13:
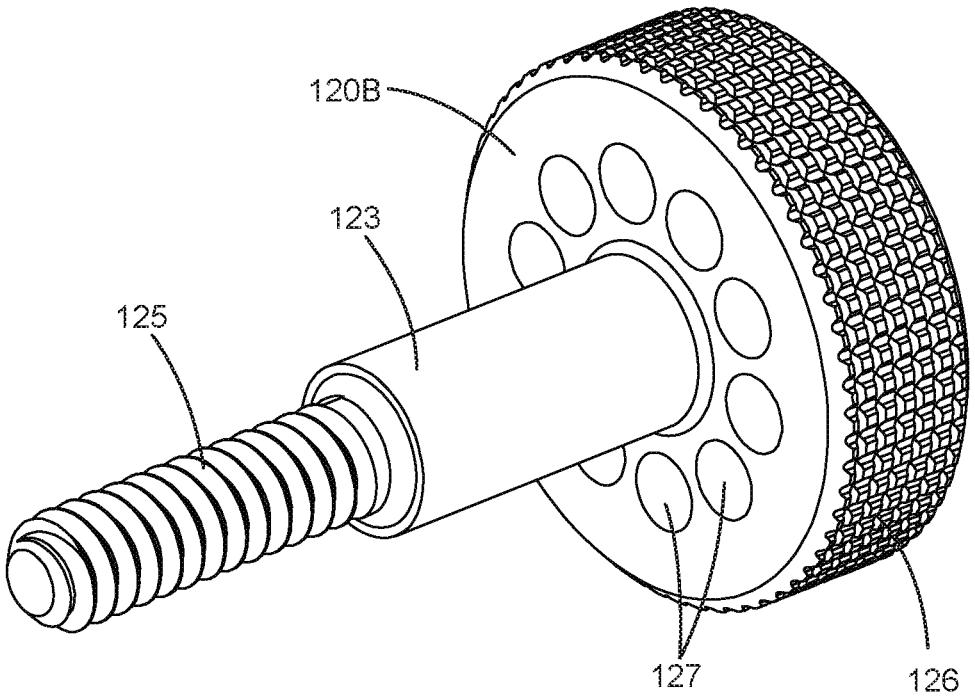
FIG. 13 shows a top perspective view of a thumbscrew with a head comprising an inner side dimpled to engage a hemispherical portion of a ball and detent assembly according to the present disclosure.
Figure 14:
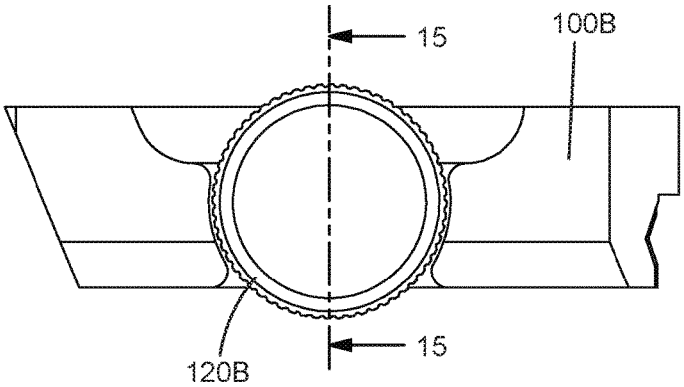
FIG. 14 shows a longitudinal side view of an example embodiment of an accessory mount with a thumbscrew with a head comprising an inner side dimpled to engage a hemispherical portion of a ball and detent assembly according to the present disclosure.
Figure 15:
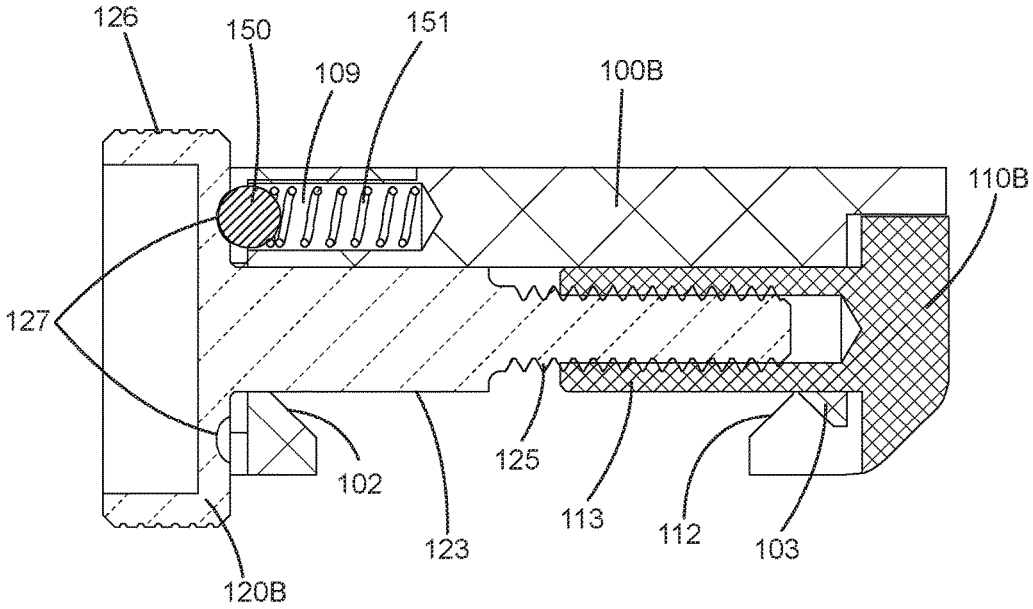
FIG. 15 is a cross-sectional view of an example embodiment of an accessory mount with a thumbscrew with a head comprising an inner side dimpled to engage a hemispherical portion of a ball and detent assembly according to the present disclosure.

FIG. 12 shows a bottom exploded view of an example embodiment of an accessory mount without shear lugs and with a ball and detent assembly engaging an inner side of a head of a thumbscrew according to the present disclosure. FIG. 13 shows a top perspective view of a thumbscrew with a head comprising an inner side dimpled to engage a hemispherical portion of a ball and detent assembly according to the present disclosure. FIG. 14 shows a longitudinal side view of an example embodiment of an accessory mount with a thumbscrew with a head comprising an inner side dimpled to engage a hemispherical portion of a ball and detent assembly according to the present disclosure. FIG. 15 is a cross-sectional view of an example embodiment of an accessory mount with a thumbscrew with a head comprising an inner side dimpled to engage a hemispherical portion of a ball and detent assembly according to the present disclosure. Some elements of this figure are described above. Thus, same reference characters identify identical and/or like components described above and any repetitive detailed description thereof will hereinafter be omitted or simplified in order to avoid complication.

A base 100B comprises the first sidewall, which defines a fifth bore 109 above a first bore 105 such that the bridge is positioned between the lateral plane and an axis of the fifth bore 109, although other positioning is possible. A stem of a thumbscrew 120B extends from a head of the thumbscrew 120B. Such stem includes a threaded portion 125 and an unthreaded portion 123. The head of the thumbscrew 120B includes a peripheral knurled surface 126, which can be of any configuration as the peripheral knurled surface 126 does not interface with the ball 150 directly. A side of the head of the thumbscrew 120B, which faces the stem of the thumbscrew 120B, comprises a plurality of regularly spaced circularly patterned scallops 127, although irregular spacing is possible in other embodiments.

The fifth bore 109 contains the ball 150 and the elastic member 151, such as a compression spring. A cross-section through a 15-15 line depicts how the ball 150 interfaces/engages/interacts with the scallops 127 on the side of the head of the thumbscrew 210, which faces the stem of the thumbscrew 210. The elastic member 151 is shown to elastically engage with the ball 150 on one end thereof and the base 100B on the other end thereof, such as at least one of the bridge or the first sidewall.

Figure 16:
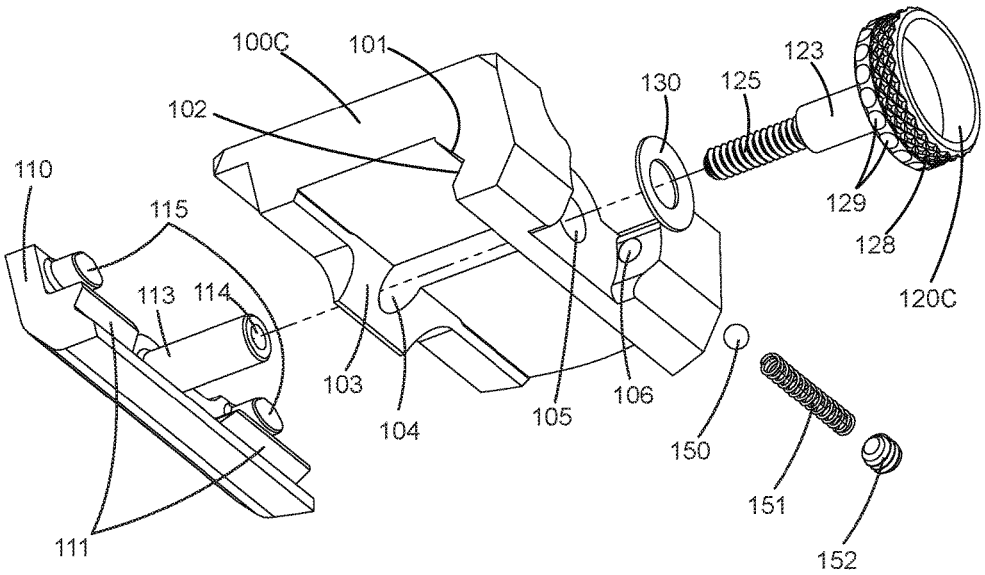
FIG. 16 shows a bottom perspective view of an example embodiment of an accessory mount with a thumbscrew equipped with a head comprising a perimetric side including a plurality of patterns one of which is dimpled to engage a hemispherical portion of a ball and detent assembly according to the present disclosure.
Figure 17:
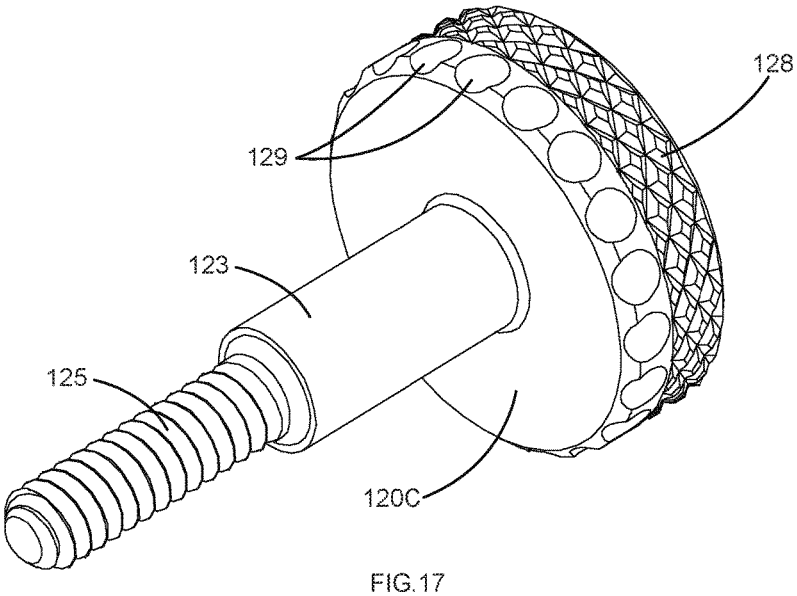
FIG. 17 shows a top perspective view of an example embodiment of a thumbscrew equipped with a head comprising a perimetric side including a plurality of patterns one of which is dimpled to engage a hemispherical portion of a ball and detent assembly according to the present disclosure.

FIG. 16 shows a bottom perspective view of an example embodiment of an accessory mount with a thumbscrew equipped with a head comprising a perimetric side including a plurality of patterns one of which is dimpled to engage a hemispherical portion of a ball and detent assembly according to the present disclosure. FIG. 17 shows a top perspective view of an example embodiment of a thumbscrew equipped with a head comprising a perimetric side including a plurality of patterns one of which is dimpled to engage a hemispherical portion of a ball and detent assembly according to the present disclosure. Some elements of this figure are described above. Thus, same reference characters identify identical and/or like components described above and any repetitive detailed description thereof will hereinafter be omitted or simplified in order to avoid complication.

A base 100C comprises a column from the first pair of columns, which defines a sixth bore 106 with a pair of open ends. The sixth bore 106 contains the elastic member 151, where the elastic member 151 elastically engages the ball 150 on one end thereof and the fastener 152 on opposing end thereof, with the fastener 152 being threaded into the sixth bore 106 via one of the open ends and the ball 150 engaging/interfacing/interacting with scallops 129 of a thumbscrew head 120C via the other end of the sixth bore 106. Note that the thumbscrew head 120C comprises a plurality of patterns, i.e., an outer side extending along a perimeter of the head 120C comprises the scallops 129 and a knurled area 128 immediately adjacent to each other, although other positioning is possible. The knurled area 128 can be of any surface configuration as the knurled area 128 does not interface with the ball 150. The scallop 129 can also be defined as peaks or valleys, as disclosed herein, or other suitable patterns to interface with the ball 150.

Figure 18:
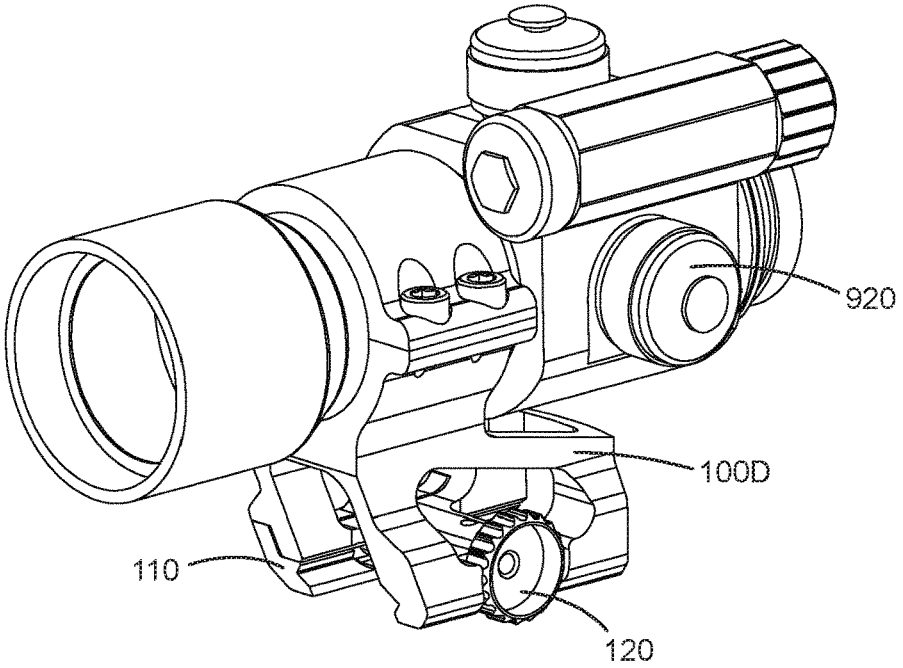
FIG. 18 shows a top perspective view of an example embodiment of an optical sighting device comprising a mount to selectively mount onto a firearm rail according to the present disclosure.

FIG. 18 shows a top perspective view of an example embodiment of an optical sighting device comprising a mount to selectively mount onto a firearm rail according to the present disclosure. Some elements of this figure are described above. Thus, same reference characters identify identical and/or like components described above and any repetitive detailed description thereof will hereinafter be omitted or simplified in order to avoid complication.

A tube shaped optical sighting device 920 is integrated with a base 100D with the thumbscrew 120 being able to fasten to the tube 113 of the plate 110.

Figure 19:
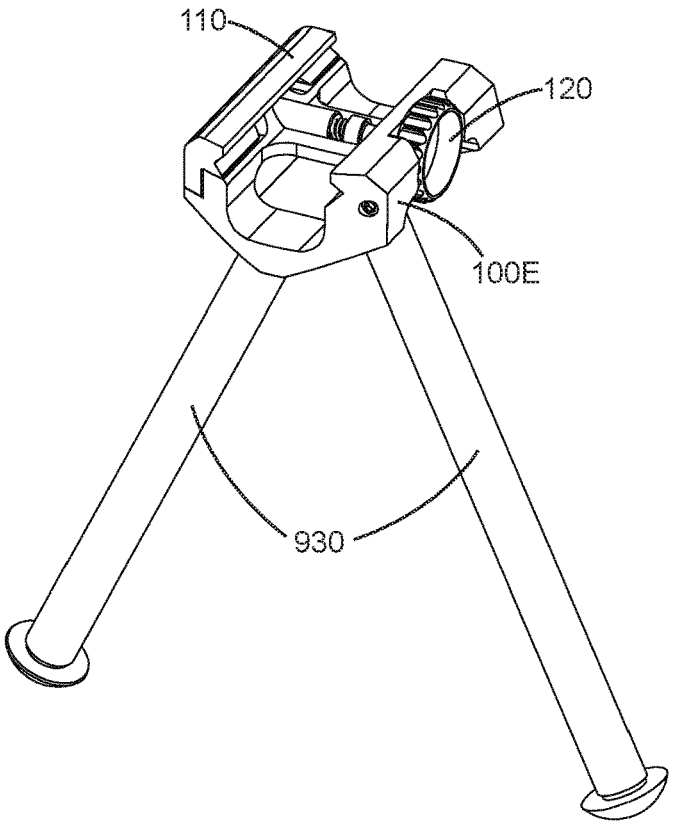
FIG. 19 shows a top perspective view of an example embodiment of a bipod comprising a mount to selectively mount onto a firearm rail according to the present disclosure.

FIG. 19 shows a top perspective view of an example embodiment of a bipod comprising a mount to selectively mount onto a firearm rail according to the present disclosure. Some elements of this figure are described above. Thus, same reference characters identify identical and/or like components described above and any repetitive detailed description thereof will hereinafter be omitted or simplified in order to avoid complication.

A bipod comprises a bipod joint and a plurality of legs 930 extending from the bipod joint. The bipod is integrated with a base 100E with the thumbscrew 120 being able to fasten to the tube 113 of the plate 110. Note that such type of clamping is from underneath the rail 900, i.e., to grip a top portion of the rail 900, in contrast to clamping from above the rail 900, i.e., to grip a bottom portion of the rail 900.

Figure 20:
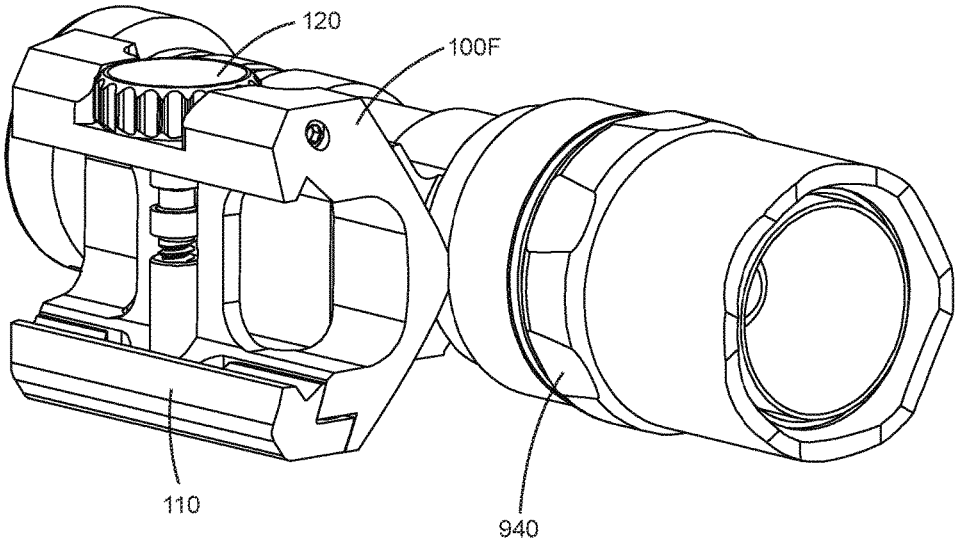
FIG. 20 shows a lateral side perspective view of an example embodiment of a lighting device comprising a mount to selectively laterally mount onto a firearm rail according to the present disclosure.

FIG. 20 shows a lateral side perspective view of an example embodiment of a lighting device comprising a mount to selectively laterally mount onto a firearm rail according to the present disclosure. Some elements of this figure are described above. Thus, same reference characters identify identical and/or like components described above and any repetitive detailed description thereof will hereinafter be omitted or simplified in order to avoid complication.

A lighting device 930 is integrated with a base 100F with the thumbscrew 120 being able to fasten to the tube 113 of the plate 110. Note that such type of clamping is from a lateral side of the rail 900 in contrast from clamping from the above the rail 900 or clamping from below the rail 900.

Figure 21:
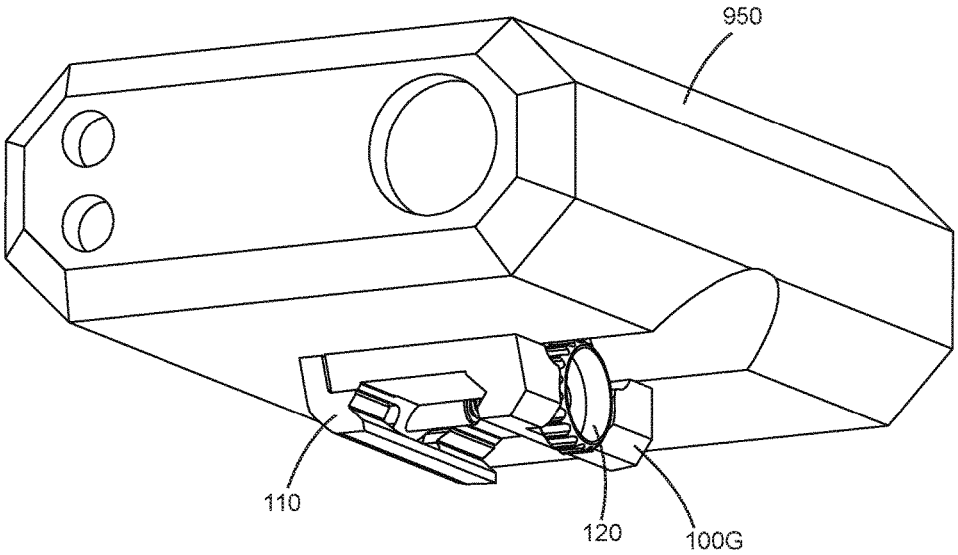
FIG. 21 shows a bottom perspective view of an example embodiment of a laser aiming device comprising a mount to selectively mount onto a firearm rail according to the present disclosure.

FIG. 21 shows a bottom perspective view of an example embodiment of a laser aiming device comprising a mount to selectively mount onto a firearm rail according to the present disclosure. Some elements of this figure are described above. Thus, same reference characters identify identical and/or like components described above and any repetitive detailed description thereof will hereinafter be omitted or simplified in order to avoid complication.

A laser aiming device 930 is integrated with a base 100G with the thumbscrew 120 being able to fasten to the tube 113 of the plate 110.

Figure 22:
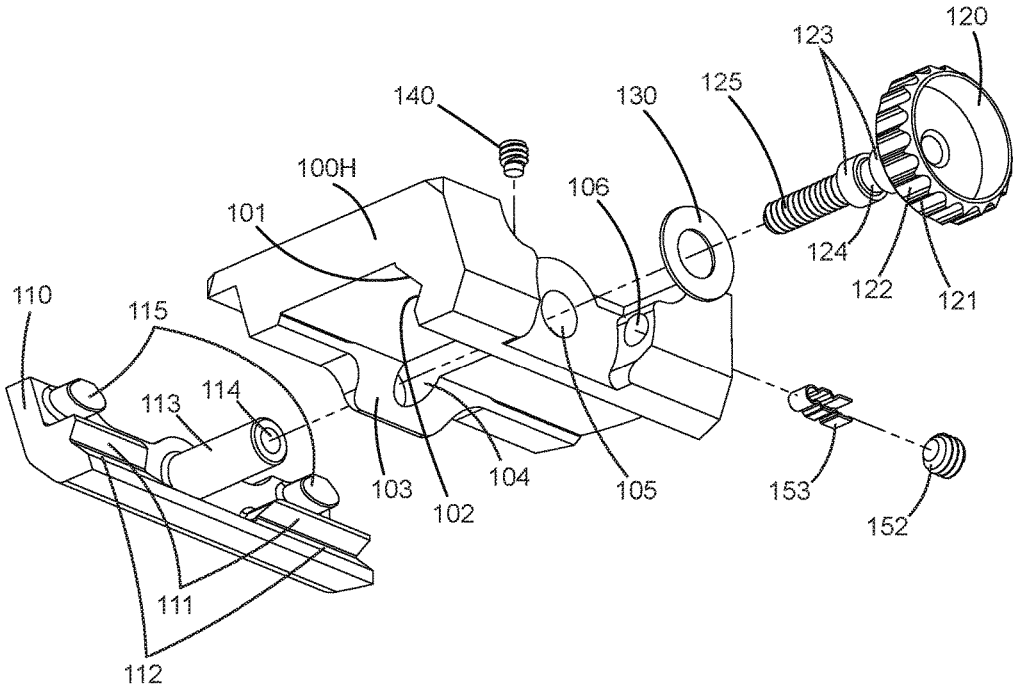
FIG. 22 shows a bottom exploded view of an example embodiment of an accessory mount with a bent sheet metal spring according to the present disclosure.
Figure 23:
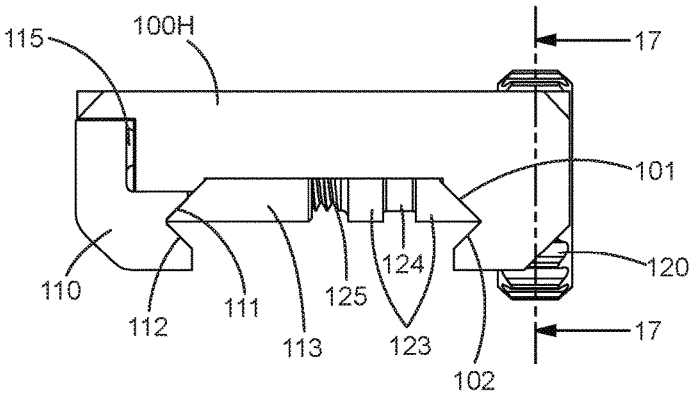
FIG. 23 shows a frontal side view of an example embodiment of an accessory mount with a bent sheet metal spring according to the present disclosure.
Figure 24:
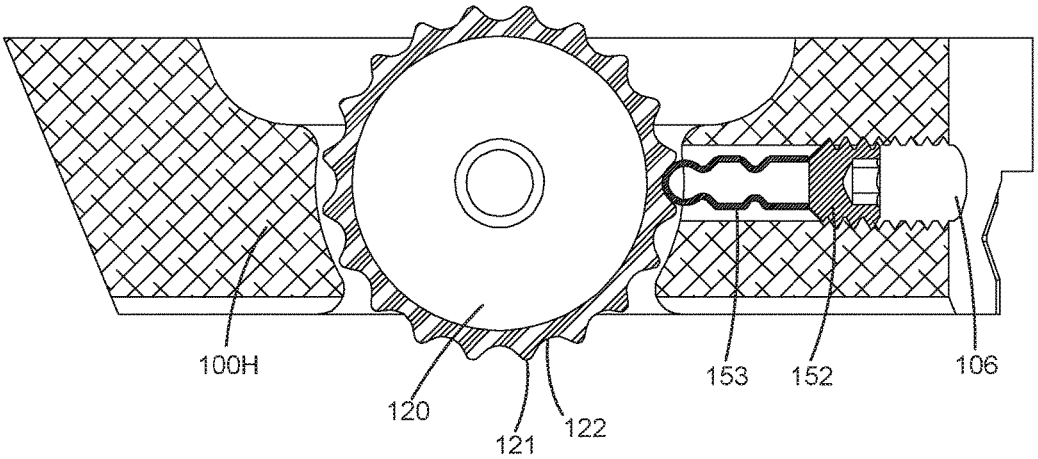
FIG. 24 is a cross-sectional view of an example embodiment of an accessory mount with a bent sheet metal spring according to the present disclosure.

FIG. 22 shows a bottom exploded view of an example embodiment of an accessory mount with a bent sheet metal spring according to the present disclosure. FIG. 23 shows a frontal side view of an example embodiment of an accessory mount with a bent sheet metal spring according to the present disclosure. FIG. 24 is a cross-sectional view of an example embodiment of an accessory mount with a bent sheet metal spring according to the present disclosure. Some elements of this figure are described above. Thus, same reference characters identify identical and/or like components described above and any repetitive detailed description thereof will hereinafter be omitted or simplified in order to avoid complication.

A base 100H comprises a column from the first pair of columns, which defines a seventh bore 106 with a pair of open ends. The seventh bore 106 contains an elastic member 153, such as a U-shaped bent sheet metal spring, although other materials or shapes are possible, such as plastic or a D-shape. The elastic member 153 engages the fastener 152 on one end thereof, i.e., an open end of the elastic member 153, with the fastener 152 being threaded into the seventh bore 106 via one of the open ends of the seventh bore 106.

A cross-section through a 17-17 line depicts how a closed end of the elastic member 153 engages/interfaces/interacts with the scallops 122 on the outer perimeter of the head of the thumbscrew 120, i.e., an outer side extending along a perimeter of the head of the thumbscrew 120.

In some embodiments, various functions or acts can take place at a given location and/or in connection with an operation of one or more apparatuses or systems. In some embodiments, a portion of a given function or act can be performed at a first device or location, and a remainder of that function or act can be performed at one or more additional devices or locations.

In some embodiments, at least one of the accessory mounts disclosed herein comprises, anywhere thereon or therein, at least one of a sensor, a processor, a circuit, a geolocation unit, an antenna, a transceiver, a camera, a microphone, or a power source. For example, at least one of the accessory mounts disclosed herein can be configured for at least one of environmental sensing or structural integrity sensing and network communication based thereon.

In some embodiments, the base 100 can comprise one or more of thumbscrews with associated plates, thumbscrews, ball and detent mechanisms, or bridges. For example, the base 100 can comprise a plurality of sub-bases positioned immediately adjacent to each other, along the rail 900 in a train manner, whether contacting each other or avoiding contact with each other.

Figure 25:
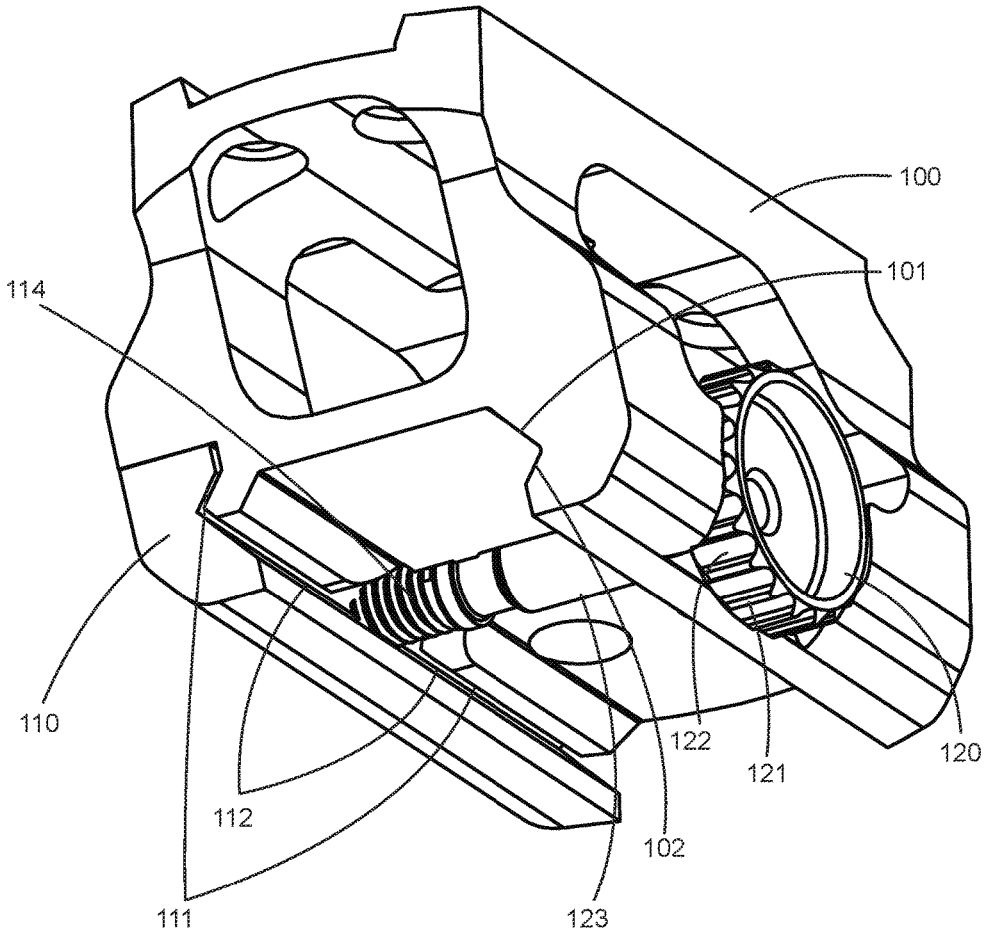
FIG. 25 shows a bottom perspective view of an example embodiment of an accessory mount according to the present disclosure.
Figure 26:
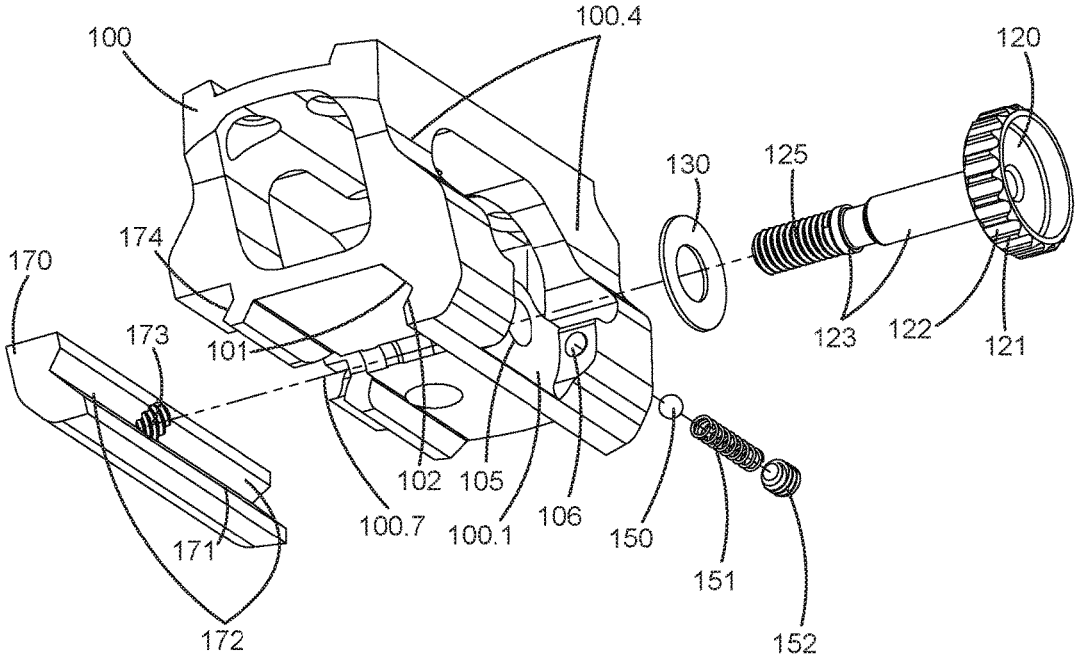
FIG. 26 shows a bottom exploded view of an example embodiment of an accessory mount according to the present disclosure.

FIG. 25 shows a bottom perspective view of an example embodiment of an accessory mount according to the present disclosure. FIG. 26 shows a bottom exploded view of an example embodiment of an accessory mount according to the present disclosure. Some elements of this figure are described above. Thus, same reference characters identify identical and/or like components described above and any repetitive detailed description thereof will hereinafter be omitted or simplified in order to avoid complication. In particular, the base 100 includes a plate 170, which may be similar to the plate 110, as shown in FIG. 7. The plate 170 defines a second jaw, as disclosed herein. The second jaw comprises an upper portion 172 of the plate 170 and a lower portion 171 of the plate 170. The plate 170 also contains a bore 173, which is threaded internally for threading with the threaded stem portion 125, as disclosed herein. Note that the bore 173 can be a well, such as via having a closed end portion, or the bore 173 can extend through the plate 170 fully therethrough, such as via having a pair of open end portions in fluid communication with each other. The base 100 further includes a pair of contact portions 174, which are structured and positioned to engage with the plate 170, as disclosed herein. For example, the contact portion 174 may engage with the plate 170 above the portion 171, such as at the upper portion 172. Note that since the plate 170 is lacking the tube 113 and the lugs 115, as shown in FIG. 7, the upper portion 172 of the plate 170 is structured differently from the upper clamping surface 111 of the plate 110, i.e. via being longitudinally continuous. Also, note that although this embodiment omits certain structural features, any embodiments disclosed herein can be combined in any way.

Figure 27:
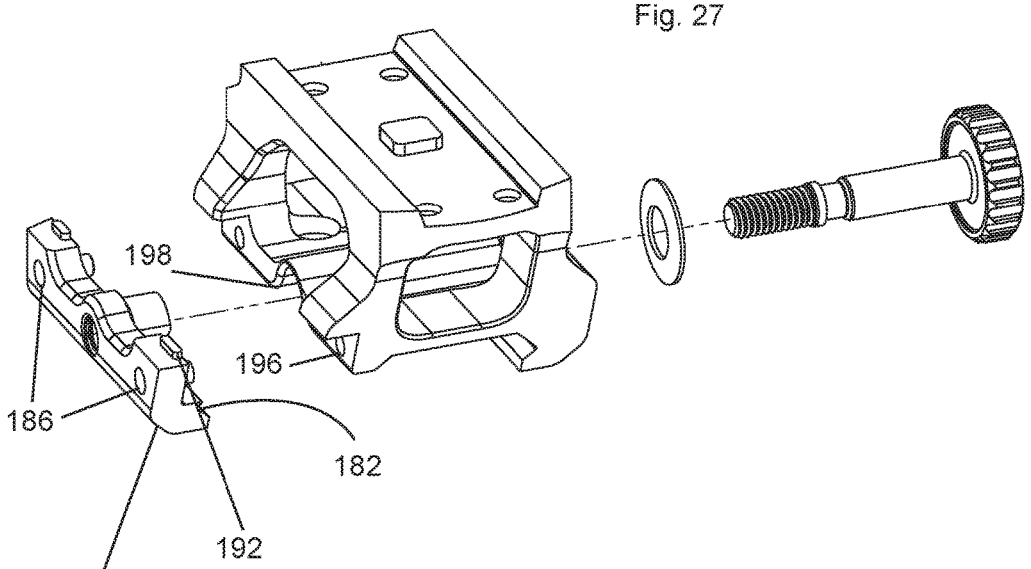
FIG. 27 shows a top perspective view of an example embodiment of an accessory mount according to the present disclosure.
Figure 28:
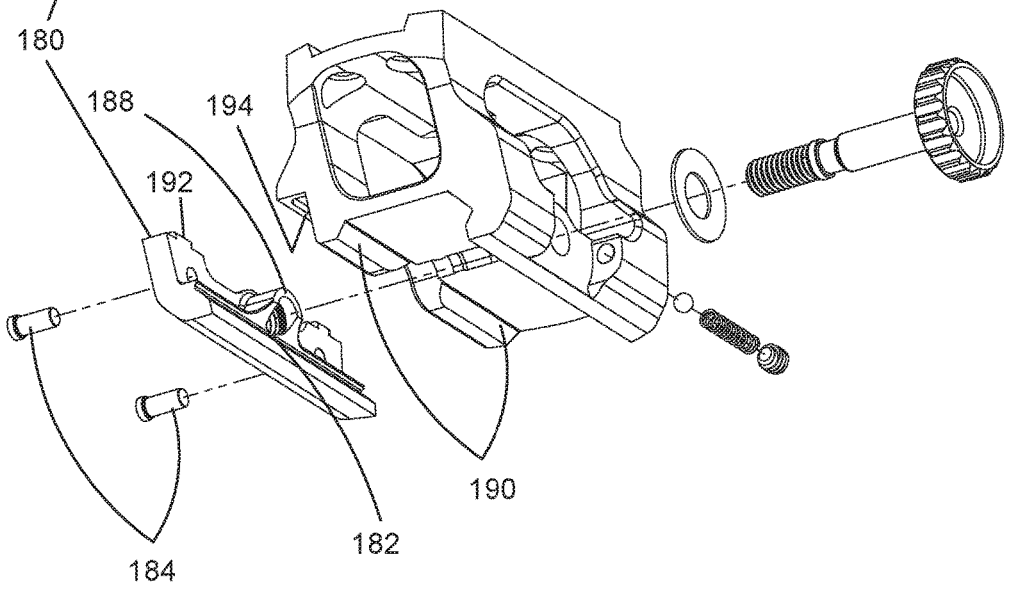
FIG. 28 shows a bottom perspective view of an example embodiment of an accessory mount according to the present disclosure.

FIG. 27 shows a top perspective view of an example embodiment of an accessory mount according to the present disclosure. FIG. 28 shows a bottom perspective view of an example embodiment of an accessory mount according to the present disclosure. Some elements of this figure are described above. Thus, same reference characters identify identical and/or like components described above and any repetitive detailed description thereof will hereinafter be omitted or simplified in order to avoid complication. In particular, the base 100 includes a plate 180, which may be similar to the plate 110, as shown in FIG. 7. Although the plate 180 is L-shaped, as shown in FIG. 27, other shapes are possible, such as a J-shape or others. The plate 180 defines a second jaw, as disclosed herein. The second jaw comprises a lower portion 182 of the plate 180. The lower portion 182 includes a bottom contact surface. The plate 180 also comprises a plurality of bores 186 and a tubular portion 188 positioned between the bores 186. The bores 186 may be smooth or threaded. The tubular portion 188 replaces the tube 113, as shown in FIG. 7. The tubular portion 188 may be internally smooth or threaded. The plate 180 further comprises a plurality of projections 192, such as a plurality of male portions, upwardly extending therefrom. Although the projections 192 are above the bores 186, this positioning may vary in other embodiments, such as when the projections 192 are offset with respect to the bores 186, whether inwardly or outwardly. The base 100 additionally includes a plurality of pins 184, which are structured for selective insertion into the bores 186. For example, the pins 184 can be bolts or screws. Note that the pins 184 can fasten into the bores 186 when the bores 186 are threaded. However, note that the pins 184 can be screwed in, press fit, glued, welded, affixed, or otherwise secured or coupled to the plate 180 via the bores 186 in some other permanent or semi-permanent way. Further, note that the pins 184 replace the lugs 115, as shown in FIG. 7.

The second sidewall 100.2 includes an arcuate portion 198 that is structured and positioned to receive the tubular portion 188 when the threaded stem portion 125 fastens into the tubular portion 188. Note that the arcuate portion 198 replaces the protruding wedge 103, as shown in FIG. 7. The second pair of columns 100.5 comprises a plurality of depressions 194, such as a plurality of female portions, inwardly extending thereinto. The projections 192 and the depressions 194 are structured to engage with each other, such as via the depressions 194 receiving the projections 192, which may be snugly. The second sidewall 100.2 includes a plurality of pockets 196 underneath the second pair of columns on the base 100. The pockets 196 are structured and positioned to receive the pins 184, similarly to the pockets 107, as shown in FIG. 8. Note that the pockets 196 may be smooth or threaded. The base 100 further includes a plurality of pillars 190 extending therefrom, which include a plurality of top contact surfaces. The pillars 190 are structured and positioned to contact the lower portion 182, such as via the top contact surfaces and the bottom contact surface, respectively, when the threaded stem portion 125 fastens into the tubular portion 188. As such, the mounting rail 900 is no longer contacted from above (902) by the upper clamping surface (111) of the plate 110, but instead by a surface/or surfaces of the portion 182 and the pillars 190.

The corresponding structures, materials, acts, and equivalents of all means or step plus function elements in the claims below are intended to include any structure, material, or act for performing the function in combination with other claimed elements as specifically claimed. The embodiments were chosen and described in order to best explain the principles of the disclosure and the practical application, and to enable others of ordinary skill in the art to understand the disclosure for various embodiments with various modifications as are suited to the particular use contemplated.

The description of the present disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of the present disclosure.

What is claimed is:

1. A firearm accessory mount comprising:

a platform;

a first pair of columns extending from the platform;

a first sidewall spanning between the first pair of columns and defining a bore;

a second pair of columns extending from the platform;

a second sidewall spanning between the second pair of columns and defining an arcuate portion, wherein the bore and the arcuate portion are collinear along a plane;

a bridge spanning between the first sidewall and the second sidewall along the plane such that the bridge is positioned between the plane and the platform;

a fastener; and a plate comprising a tubular portion extending therefrom, wherein the tubular portion comprises an open end portion, wherein the tubular portion extends through the arcuate portion when the fastener extends through the bore along the bridge into the open end portion such that the fastener fastens to the tubular portion.

2. The firearm accessory mount of claim 1, wherein the bore is a first bore, wherein the second sidewall defines a second bore, wherein the arcuate portion defines the second bore.

3. The firearm accessory mount of claim 1, wherein the plate comprises a plurality of projections extending therefrom such that the tubular portion is positioned therebetween, wherein the second sidewall defines a plurality of depressions that receive the projections when the tubular portion engages the arcuate portion.

4. The firearm accessory mount of claim 1, wherein the fastener is a first fastener, wherein the bore is a first bore, and further comprising:

a second fastener, wherein the bridge defines a second bore, wherein the second fastener engages the first fastener between the first sidewall and the second sidewall when the second fastener extends through the second bore.

5. The firearm accessory mount of claim 1, further comprising:

a spring mounted onto the fastener such that the first sidewall is positioned between the spring and the second sidewall.

6. The firearm accessory mount of claim 1, further comprising:

a ball detent engaging the fastener.

7. The firearm accessory mount of claim 6, wherein the fastener comprises a stem and a head, wherein the ball detent engages the stem.

8. The firearm accessory mount of claim 6, wherein the fastener comprises a stem and a head, wherein the ball detent engages the head.

9. The firearm accessory mount of claim of claim 1, wherein the platform is unitary with the first pair of columns and the second pair of columns.

10. The firearm accessory mount of claim of claim 1, wherein the plate is unitary with the tubular portion.

11. The firearm accessory mount of claim of claim 1, wherein the bridge is unitary with the first sidewall and the second sidewall.

12. The firearm accessory mount of claim of claim 1, wherein the fastener is a thumbscrew.

13. The firearm accessory mount of claim of claim 1, wherein the tubular portion extends past the arcuate portion towards the bore.

14. The firearm accessory mount of claim of claim 1, wherein the bore is a first bore, wherein the platform defines a second bore therein.

15. A firearm accessory mount comprising:

a first sidewall including a first jaw and a bore, wherein the first jaw is structured to grip a first firearm rail side;

a second sidewall including an arcuate portion that is collinear with the bore along a plane;

a bridge spanning between the first sidewall and the second sidewall along the plane;

a fastener; and a plate including a second jaw and a tubular portion with an open end portion, wherein the second jaw is structured to grip a second firearm rail side as the tubular portion extends through the arcuate portion when the fastener extends through the bore along the bridge into the open end portion such that the fastener fastens to the tubular portion.

16. The firearm accessory mount of claim 15, wherein the bore is a first bore, wherein the second sidewall defines a second bore, wherein the arcuate portion defines the second bore.

17. The firearm accessory mount of claim 15, wherein the plate comprises a plurality of projections extending therefrom such that the tubular portion is positioned therebetween, wherein the second sidewall defines a plurality of depressions that receive the projections when the tubular portion engages the arcuate portion.

18. A device comprising:

a firearm accessory;

a first sidewall defining a bore and supporting the firearm accessory;

a second sidewall defining an arcuate portion and supporting the firearm accessory, wherein the bore and the arcuate portion are collinear along a plane;

a bridge spanning between the first sidewall and the second sidewall along the plane such that the bridge is positioned between the plane and the firearm accessory;

a fastener; and a plate including a jaw and a tubular portion with an open end portion, wherein the jaw is structured to grip a second firearm rail side as the tubular portion extends through the arcuate portion when the fastener extends through the bore along the bridge into the open end portion such that the fastener fastens to the tubular portion.

* * * * *